US006664724B2

(12) United States Patent
Lim

(10) Patent No.: US 6,664,724 B2
(45) Date of Patent: Dec. 16, 2003

(54) SHADOW MASK FOR COLOR CRT

(75) Inventor: Min-Ho Lim, Daegu (KR)

(73) Assignee: LG. Philips Display Korea Co., Ltd., Seoul (KR)

( * ) Notice: Subject to any disclaimer, the term of this patent is extended or adjusted under 35 U.S.C. 154(b) by 0 days.

(21) Appl. No.: 10/154,820

(22) Filed: May 28, 2002

(65) Prior Publication Data

US 2003/0102794 A1 Jun. 5, 2003

(30) Foreign Application Priority Data

Nov. 10, 2001 (KR) ..... 2001-69967

(51) Int. Cl.[7] ..... H01J 29/80

(52) U.S. Cl. ..... 313/402; 313/403; 313/404; 313/407; 313/408

(58) Field of Search ..... 313/402, 403, 313/408, 404, 407

(56) References Cited

U.S. PATENT DOCUMENTS 3,705,322 A 12/1972 Naruse et al. ..... 313/85 S
6,342,757 B1 * 1/2002 Shin et al. ..... 313/403
6,411,025 B1 * 6/2002 Bae ..... 313/408
6,570,310 B1 * 5/2003 Aibara ..... 313/403

* cited by examiner

*Primary Examiner*—Nimeshkumar D. Patel
*Assistant Examiner*—Holly Harper
(74) *Attorney, Agent, or Firm*—Fleshner & Kim, LLP

(57) ABSTRACT

In a shadow mask for a color cathode ray tube including a plurality of slots in which electron beams pass, a roughly rectangular-shaped effective surface having long sides and short sides and a skirt portion downwardly curved-extended from the outer surface of the effective surface, wherein a horizontal pitch at the central portion of a shadow mask satisfies a condition of $W \times 0.08\% \leqq Pho \leqq W \times 0.086\%$ when a horizontal pitch at the central portion of a shadow mask slot is Pho, a screen effective surface long side length is W and the shadow mask central portion is placed on the center in which the shadow mask effective surface long side is divided into three equal parts. In addition, the shadow mask satisfies a condition of $Pho \times 0.24 \leqq Sw \leqq Pho \times 0.30$ when a slot horizontal width at the shadow mask central portion is Sw. Accordingly, definition lowering occurred due to a screen horizontal pitch increase can be minimized and simultaneously color purity lowering according to a horizontal pitch decrease can be prevented.

2 Claims, 4 Drawing Sheets

SHADOW MASK FOR COLOR CRT

BACKGROUND OF THE INVENTION

1. Field of the Invention

The present invention relates to a shadow mask for a color CRT (cathode ray tube), and in particular to a slot interval of a shadow mask for a color CRT (cathode ray tube).

2. Description of the Prior Art

FIG. 1 is a schematic view illustrating a general color CRT (cathode ray tube), and FIG. 2 is a perspective view illustrating a general shadow mask.

Generally, as depicted in FIG. 1, in a color CRT, a panel 10 as a front glass is combined with a funnel 20 as a rear glass, and they are hermetically sealed as high vacuum.

And, the color CRT includes a fluorescent surface 40 coated to the inner surface of the panel 10 and performing a luminescent material function, an electron gun 130 discharging an electron beam 60 for radiating the fluorescent surface 40, a shadow mask 70 for making the electron beam from the electron gun 130 land on a certain portion of the fluorescent surface 40, a frame 30 fixing/supporting the shadow mask 70, a spring 80 and a stud pin 120 for combining the frame assembly 30 with the panel 10, and an inner shield 90 combined with a certain surface of the frame 30 and extended from the panel side to the funnel side in order to protect the CRT from influences of terrestrial magnetism in operation.

And, the electron gun 130 for generating the electron beam 60 is installed to the internal surface of the neck portion of the funnel 20, a deflection yoke 50 is installed to the outer surface of the neck portion of the funnel 20 in order to deflect the electron beam 60 from the electron gun 130 in a certain direction, and a CPM (convergence & purity magnet) 100 for precisely adjusting the deflected direction of the electron beam 60.

And, a reinforcing band 110 is installed to the outer circumference of the combining portion of the panel 10 and the funnel 20 in order to help the panel 10 and the funnel 20 stand an air pressure and external impacts.

In addition, as depicted in FIG. 2, the conventional shadow mask 70 includes an effective surface 74 having a plurality of circular-shaped or oval-shaped slots 72 and a skirt 76 having a certain length so as to be welded to the frame 30.

FIG. 3 illustrates a part of the effective surface 74 of the shadow mask 70, in order to make the electron beam 60 maintain a certain interval when it passes the slots 72 on the effective surface 74 of the shadow mask 70 and lands on the fluorescent surface 40 coated on the panel 10, the slots 72 respectively having a certain sized hole are arranged horizontally and vertically at regular intervals.

In addition, on the shadow mask 70, in order to maintain a strength after fabrication, each bridge 78 is formed between abutted two vertical slots 72.

In FIGS. 3 and 4, a non-explained reference numeral Ph is a horizontal pitch of a screen, Pho is a horizontal pitch at the central portion of the shadow mask 70, and Phd is a horizontal pitch at the circumference of the shadow mask 70.

As depicted in FIG. 4, in a horizontal pitch Ph of the conventional color CRT screen, the slots 72 are arranged at regular intervals from the central portion toward a long axis, a short axis and a diagonal axis about X, Y axes of the shadow mask 70 or the slot interval is increased or decreased according to a certain X, Y functions or a slot column function.

And, the horizontal pitch Ph of the screen is set according to a definition of an expected screen of the color CRT. In general, the horizontal pitch Ph set as 0.095%~0.115% of the screen long side length (W) at the central portion, and a slot horizontal width (Sw) at the central portion is 27%~28% of the horizontal pitch Pho at the central portion of the mask 70.

The shadow mask 70 passes a curved surface fabrication process, is welded to the frame 30 and fixed to the internal surface of the panel 10 so as to have a certain distance from the interior of the panel 10 in order to disperse and land the red, green, blue electron beam 60 emitted from the electron gun 130 on the screen of the panel 10 at which the fluorescent surface 40 is formed.

In the above-described shadow mask 70, a resolution meaning a capacity for reproducing a picture is described as a product of a shadow mask definition and an electric beam definition, the definition varies depending on the shadow mask definition rather than the electron beam definition.

The shadow mask definition can be described as Equation 1.

$$\text{Mask} - MTF_{\max} = \cos\left(\frac{\theta}{2}\pi P_h \mu\right) = 2\left\{\frac{1}{2P_h\mu} - \left(\frac{1}{P_h} + 0.5\right)\right\} \quad \text{[Equation 1]}$$

$$\theta = 2\left\{\frac{1}{2P_h\mu} - \left(\frac{1}{P_h} + 0.5\right)\right\}, \mu = \frac{N}{2W}$$

*Mask-MTF: definition of a shadow mask
Ph: horizontal pitch of a shadow mask
*m: spatial frequency
*N: the number of definition pixels
*W: screen long side length When a definition (Mask-MTF) value of the shadow mask 70 is not less than 0.5, the horizontal pitch (Pho) applied to the central portion of the shadow mask 70 has a pertinent definition reproduction capacity. Herein, the 0.5 definition value was set on the basis of a bright ratio of a picture reproduced for a person having ordinary eyesight.

In addition, in consideration of an eyesight angle of a viewer, when a screen is divided into three equal parts, not right and left parts but the center part is important in perfect reproduction of a high definition picture.

However, in the conventional shadow mask, in particular, a shadow mask in Japan Patent 1999-007901 has a horizontal pitch of 0.088%~0.123%. As depicted in FIG. 5 and Table 1, it satisfies only low definition and intermediate definition such as a NTSC or a PAL, etc.

TABLE 1

| HORIZONTAL PITCH RATIO | NTSC | PAL | STANDARD DEFINITION | HIGH DEFINITION |
|---|---|---|---|---|
| 0.095% | ○ | ○ | ○ | Δ |
| 0.105% | ○ | ○ | ○ | X |
| 0.115% | ○ | ○ | Δ | X |

*○: perfect picture reproduction *Δ: imperfect picture reproduction
*X: reproduction impossible
*horizontal pitch ratio: shadow mask horizontal pitch ratio about a screen long side length When the conventional level horizontal pitch is used for high definition picture reproduction, because it is insufficient to reproduce a high definition picture provided from a broadcast station or a picture equipment, a definition reproduction capacity is low, accordingly a viewer's sensitivity quality can not be secured.

In addition, when the horizontal pitch is reduced over than a necessity, as depicted in FIG. 6, a purity margin is reduced, it causes problems in color reproduction of a high definition picture.

In general, a purity margin means a possibility in which an electron beam hits a fluorescent portion abutting on a target fluorescent portion without landing on the pertinent fluorescent portion. FIG. 6 describes it.

As depicted in FIG. 6, there are a screen horizontal pitch (Ph), a screen fluorescent band (a), a screen black matrix band (d) and an electron beam horizontal width (b) as main factors determining a purity margin (c).

The screen horizontal pitch (Ph) is formed on a screen by multiplying a horizontal pitch (Pho) on the central portion of the shadow mask 70 by a pitch magnifying power ($\alpha$) determined by a distance between a screen and a shadow mask and an interval ratio between the screen and a panel, the horizontal pitch (Pho) at the central portion of the shadow mask is considered importantly in determining a screen horizontal pitch (Ph).

And, an electron beam horizontal width (b) is obtained by multiplying a slot width (Sw) of the shadow mask 70 by an electron beam magnifying power ($\beta$).

And, the screen fluorescent band (a) and the block matrix band (d) are determined by considering a brightness, etc.

As an example of FIG. 6, in a color cathode ray tube including a 32 inches shadow mask having a width of 0.25 mm and a long side effective surface length of 662.4 mm, a horizontal pitch (Pho) at the central portion of the shadow mask as 0.095% of the screen long side length (W) is 0.629 mm, and a magnified screen horizontal pitch (Ph) is 0.660 mm.

When the fluorescent band (a) is 0.120 mm, the black matrix band (d) is 0.100 mm, a shadow mask slot width as 27% of the shadow mask horizontal pitch is 0.170 mm, when the electron beam magnifying power ($\beta$) is applied to the shadow mask slot width, an electron beam horizontal width (b) is 0.229 mm.

Herein, a purity margin in one direction is 0.045 mm.

However, when a front surface of the screen is rotated toward the four directions in consideration of a picture watching direction, an electron beam in which a motion direction is varied by an earth magnetic field may hit a screen fluorescent portion abutting on a target screen fluorescent portion, herein it is important to maintain a color purity despite of that variation, it is called a direction rotation margin.

In order to satisfy the direction rotation margin characteristic, a margin of 0.015 mm is required, however there is a margin of 0.010 mm in consideration of a margin of 0.020 mm on the basis of error occurrence in the fabrication process, the margin is two little, accordingly a yielding rate is lowered.

In more detail, the less the fluorescent band on the central portion, the more the purity margin is secured. However, when the screen fluorescent band (a) is smaller than 0.100 mm, possibility of screen picture spreading is increased due to the screen fluorescent formation error, a luminance (brightness) and a luminance uniformity is lowered due to reduction of electron beam utilization ratio as a ratio of the screen fluorescent band (a) and the electron beam horizontal width (b) calculated as Equation 2, the screen fluorescent band (a) has not to be smaller than 0.100 mm.

$$\text{luminance} = \text{luminescent calibrating constant} \times \text{mask transmissibility} \times \text{glass transmissibility} \times \text{electron beam utilization ratio} \quad \text{[Equation 2]}$$

Accordingly, when a pitch (Pho) at the central portion of the shadow mask determining a screen horizontal pitch (Ph) is set small, a purity margin can not be secured and a color purity may be lowered, accordingly it may deteriorate a color reproduction.

Accordingly, it is required to set an appropriate shadow mask slot horizontal width (Sw) which is capable of solving a purity margin decrease problem according to a horizontal pitch (Pho) setting at the central portion of the shadow mask obtainable a definition and a horizontal pitch reduction at the central portion of the shadow mask.

SUMMARY OF THE INVENTION

In order to solve the above-mentioned problem, it is an object of the present invention to provide a shadow mask for a color cathode ray tube which is capable of minimizing definition lowering occurred in a screen according to a screen horizontal pitch increase and preventing color purity lowering according to a screen horizontal pitch decrease.

In order to achieve the above-mentioned object, in a shadow mask for a color cathode ray tube including a plurality of slots in which electron beams pass, a roughly rectangular-shaped effective surface having long sides and short sides and a skirt portion downwardly curved-extended from the outer surface of the effective surface, wherein a horizontal pitch at the central portion of a shadow mask satisfies a condition of $W \times 0.08\% \leqq Pho \leqq W \times 0.086\%$ when a horizontal pitch at the central portion of a shadow mask slot is Pho, a screen effective surface long side length is W and the shadow mask central portion is placed on the center in which the shadow mask effective surface long side is divided into three equal parts.

In addition, in the present invention, a shadow mask satisfies a condition of $Pho \times 0.24 \leqq Sw \leqq Pho \times 0.30$ when a slot horizontal width at the shadow mask central portion is Sw.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
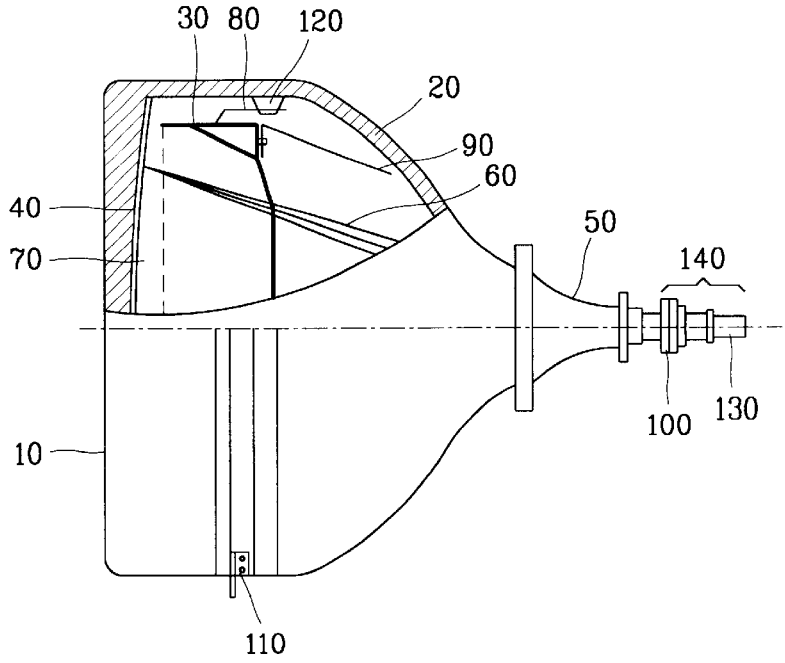
FIG. 1 CONVENTIONAL ART
FIG. 1 is a schematic sectional view illustrating the conventional color cathode ray tube.

Hereinafter, the present invention will be described with reference to accompanying drawings.

The same parts as those of the conventional art will have the same reference numerals in order to avoid overlapping of description.

Figure 7:
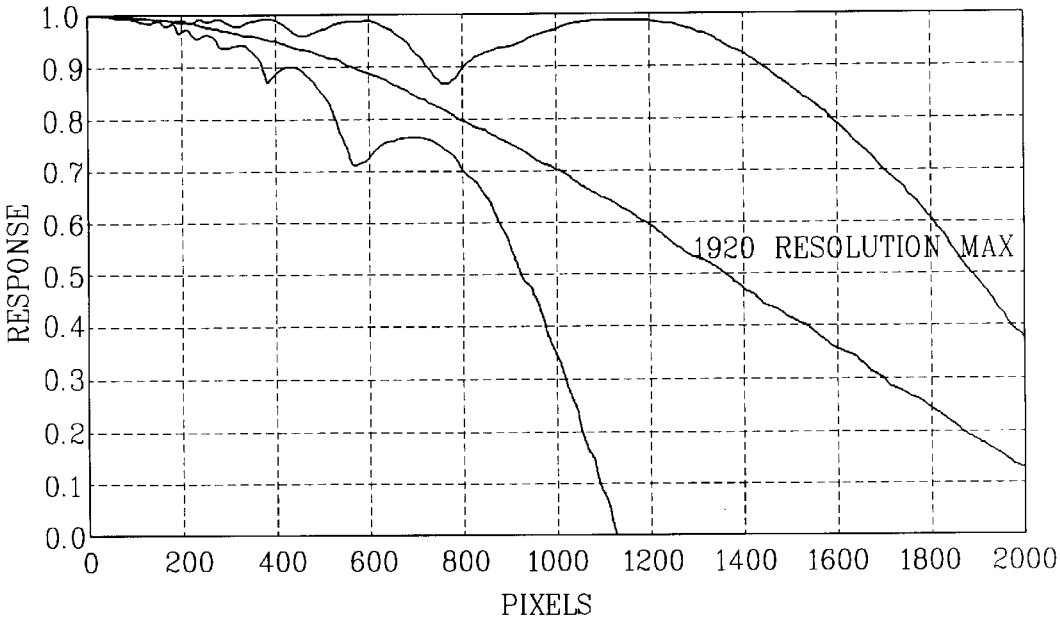
FIG. 7 is a graph illustrating a definition when a horizontal pitch is applied to a shadow mask of a color cathode ray tube in accordance with the present invention.

As depicted in a graph in FIG. 7 and Equation 1 of the conventional art, a horizontal pitch (Pho) at the central portion of the shadow mask is smaller than 0.086% of a screen long side length (W) in order to reproduce a picture having a high definition, accordingly a high definition can be obtained as depicted in Table 2.

TABLE 2

| HORIZONTAL PITCH RATIO | NTSC | PAL | STANDARD DEFINITION | HIGH DEFINITION |
|---|---|---|---|---|
| 0.075% | ○ | ○ | ○ | ○ |
| 0.080% | ○ | ○ | ○ | ○ |
| 0.086% | ○ | ○ | ○ | ○ |
| 0.095% | ○ | ○ | ○ | Δ |

*○: Perfect Picture Reproduction
*Δ: Imperfect Picture Reproduction

Figure 2:
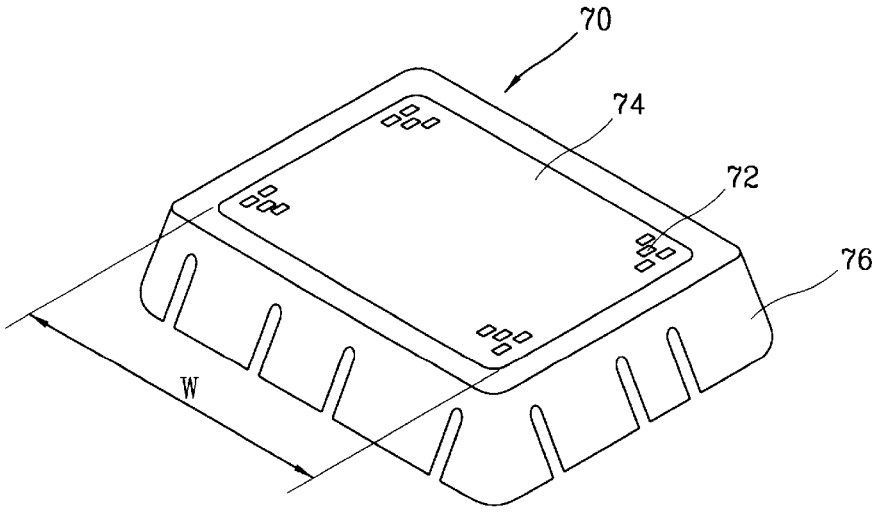
FIG. 2 CONVENTIONAL ART
FIG. 2 is a schematic view illustrating a part of a magnified effective surface of a shadow mask of the conventional color cathode ray tube.
Figure 3:
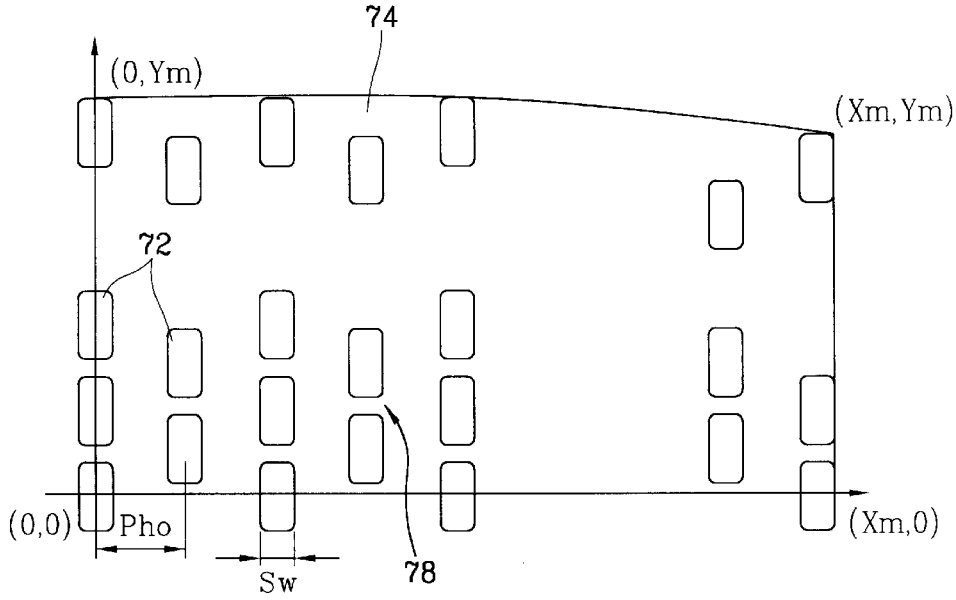
FIG. 3 CONVENTIONAL ART
FIG. 3 is a schematic view illustrating a part of a magnified effective surface of a shadow mask of the conventional color cathode ray tube.
Figure 4:
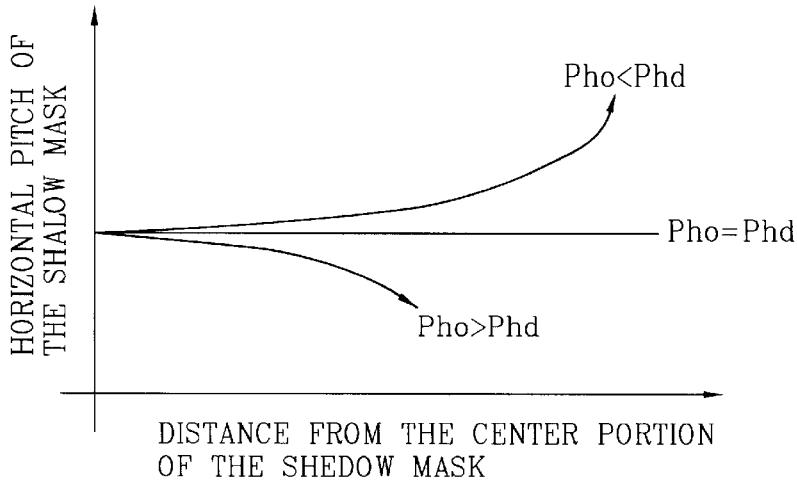
FIG. 4 CONVENTIONAL ART
FIG. 4 is a graph illustrating a relation between a central portion horizontal pitch and an outer surface horizontal pitch of the conventional cathode ray tube.
Figure 5:
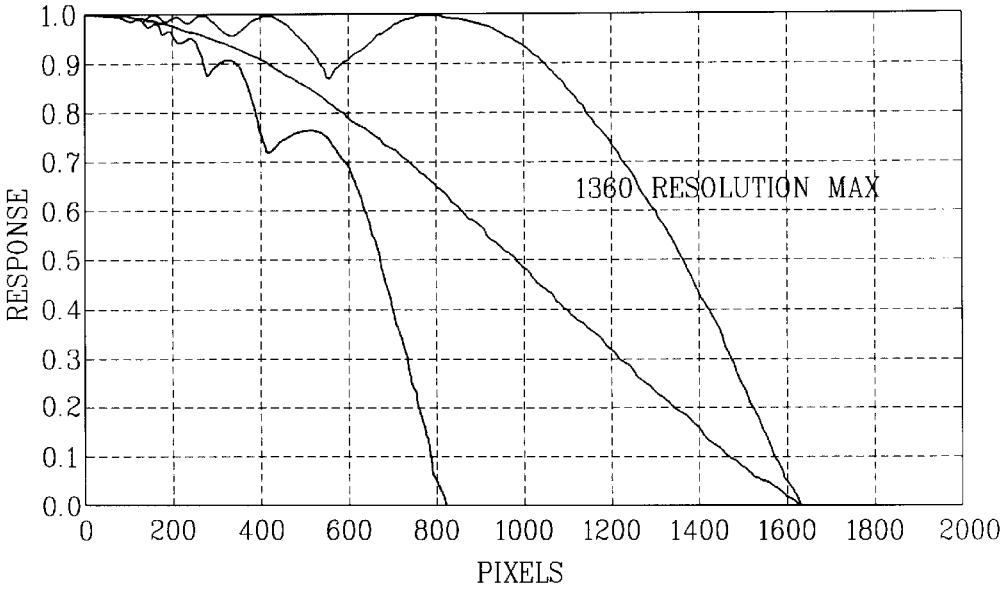
FIG. 5 CONVENTIONAL ART
FIG. 5 is a graph illustrating a definition when a horizontal pitch is applied to the conventional shadow mask.

As depicted in FIG. 2, when a horizontal pitch (Pho) at the central portion of the shadow mask is smaller than 0.086% of a screen long side length (W), a picture having a high definition can be reproduced.

However, the horizontal pitch (Pho) at the central portion of the shadow mask satisfying a color purity and a purity margin has a lower limit according to a shadow mask slot width (Sw) determining an electron beam horizontal width (b).

In the same slot width (Sw) of a shadow mask slot 72 as the conventional art, when the horizontal pitch (Pho) at the central portion of the shadow mask is excessively reduced, color purity lowering and purity margin decrease may occur.

Accordingly, the shadow mask slot width (Sw) has to be adjusted (reduced) according to the horizontal pitch (Pho) decrease at the central portion of the shadow mask.

However, the shadow mask slot width (Sw) is determined by a thickness of the shadow mask 70. In more detail, because of characteristics of shadow mask fabrication process forming a slot having a certain size by coating an etching liquid to a metal substrate, a fabricatable minimum value of the shadow mask slot width (Sw) is 60% of a thickness of a shadow mask material.

Figure 6:
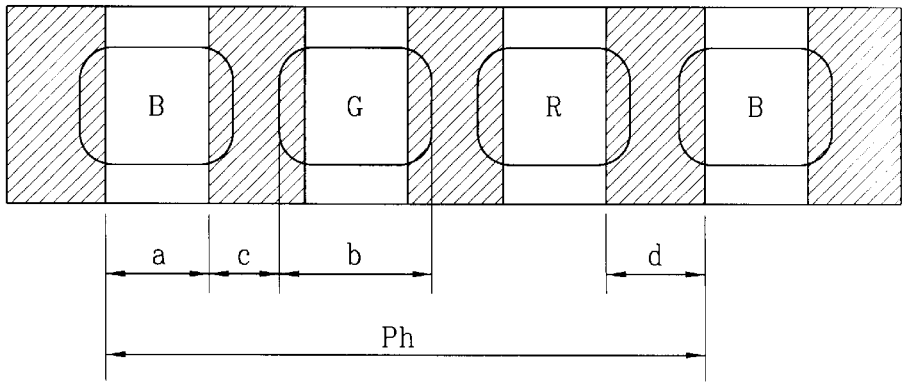
FIG. 6 CONVENTIONAL ART
FIG. 6 is a sectional view illustrating the conventional screen horizontal pitch, fluorescent band, black matrix band, purity margin, etc.

In consideration of the above-described contents, as an example of FIG. 6, in a color cathode ray tube including a 32 inches shadow mask 70 having a long side effective surface length (W) of 662.4 mm and a width of 0.25 mm, a purity margin can be calculated as below Table 3.

A magnified screen horizontal pitch (Ph) of a horizontal pitch (Pho) at the central portion of the shadow mask is 0.598 mm as 0.086% of a screen long side length (W), when a fluorescent band (a) is 0.100 mm, a black matrix band (d) is 0.099 mm, herein a shadow mask slot horizontal width (Sw) as 25% of the horizontal pitch (Pho) at the central portion of the shadow mask is 0.142 mm, when the electron beam magnifying power (β) is applied to it, an electron beam horizontal width (b) is 0.192 mm. Herein, a purity margin in one direction is 0.053 mm.

In order to satisfy directional rotation margin characteristics, a margin of 0.015 mm is required. In addition, in consideration of a margin 0.020 mm on the basis of an operational error in fabrication process, there is a margin of 0.018 mm, in comparison with the conventional purity margin it is improved as 80%.

In addition, in another example, when a magnified screen horizontal pitch (Ph) of the horizontal pitch (Pho) at the central portion of the shadow mask as 0.075% of the screen long side length (W) is 0.521 mm and a fluorescent band (a) is 0.100 mm, a black matrix band (d) exceeds a fabrication limit value of a shadow mask thickness.

Accordingly, a shadow mask slot width (Sw) is not 0.124 mm but 0.140 mm, when an electron magnifying power (β) is applied to it, an electron beam horizontal width (b) is 0.189 mm.

Herein, a purity margin in one direction is 0.029 mm.

In order to satisfy directional rotation margin characteristics, a margin of 0.015 mm is required. In addition, in consideration of a margin 0.020 mm on the basis of an operational error in fabrication process, it is deteriorated as 45% in comparison with the conventional purity margin.

In addition, when a thickness of the shadow mask 70 is reduced, a fabricatable shadow mask slot width (Sw) can be reduced, however a shadow mask strength is lowered due to the thickness reduction, accordingly a reliability (howling, drop characteristic, etc.) is comparatively lowered.

Accordingly, in order to maintain the conventional purity margin standard while satisfying a high definition, it is preferable for a horizontal pitch (Pho) at the central portion of the shadow mask to be 0.080%~0.086% of a screen effective surface long side length (W).

In addition, it is preferable for a slot width (Sw) of the shadow mask central portion to be 24%~30% of the shadow mask horizontal pitch.

When a picture having a high definition is displayed on a screen, in the present invention, definition lowering phenomenon occurred on the screen according to a horizontal pitch increase can be minimized and simultaneously a purity margin can be secured, accordingly a picture having a high definition can be stably provided by solving problems deteriorating a quality of the screen.

In addition, there is no need to get a screen fluorescent band small, a uniform luminance on the circumference

TABLE 3

| HORIZONTAL PITCH RATIO (%) | SCREEN HORIZONTAL PITCH (mm) | BLACK MATRIX BAND (mm) | FLUORESCENT BAND (mm) | ELECTRON BEAM HORIZONTAL WIDTH (mm) | PURITY MARGIN (mm) | SLOT WIDTH (mm) |
|---|---|---|---|---|---|---|
| 0.075 | 0.521 | 0.074 | 0.100 | 0.189 | 0.029 | 0.140 |
| 0.080 | 0.556 | 0.087 | 0.100 | 0.189 | 0.042 | 0.140 |
| 0.086 | 0.598 | 0.099 | 0.100 | 0.192 | 0.053 | 0.143 |
| 0.095 | 0.660 | 0.100 | 0.120 | 0.230 | 0.045 | 0.170 |

(Application Condition)
*Horizontal pitch magnifying power (α): 1.049
*Electron beam magnifying power (β): 1.35
*Horizontal Pitch of Shadow Amsk (Pho): shadow mask horizontal pitch ratio about a screen long side length
*slot width of a shadow mask (Sw): horizontal pitch×0.25 (fabrication impossible in a shadow mask thickness not greater than 60%)

portions and the central portion can be secured, accordingly a production quantity of a color cathode ray tube can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. In a shadow mask for a color cathode ray tube including a plurality of slots in which electron beams pass, a roughly rectangular-shaped effective surface having long sides and short sides and a skirt portion downwardly curved-extended from the outer surface of the effective surface, wherein a horizontal pitch at the central portion of a shadow mask satisfies $$W\times 0.08\% \leqq Pho \leqq W\times 0.086\%$$

when a horizontal pitch at the central portion of a shadow mask slot is Pho, a length of a screen effective surface long side is W and the shadow mask central portion is placed on the center in which the shadow mask effective surface long side is divided into three equal parts.

2. The shadow mask of claim 1, wherein the shadow mask satisfies $Pho\times 0.24 \leqq Sw \leqq Pho\times 0.30$ when a slot horizontal width at the central portion of the shadow mask is Sw.

* * * * *